US008101004B2

(12) United States Patent
Gay et al.

(10) Patent No.: US 8,101,004 B2
(45) **Date of Patent: *Jan. 24, 2012**

(54) PROCESS FOR MANUFACTURING STEEL BLANKS

(75) Inventors: Gérald Gay, Saint Etienne (FR); Bruno Gaillard-Allemand, Grazac (FR)

(73) Assignee: Aubert & Duval, Paris (FR)

( * ) Notice: Subject to any disclaimer, the term of this patent is extended or adjusted under 35 U.S.C. 154(b) by 0 days.

This patent is subject to a terminal disclaimer.

(21) Appl. No.: 12/376,281

(22) PCT Filed: Aug. 2, 2007

(86) PCT No.: PCT/EP2007/058035

§ 371 (c)(1),
(2), (4) Date: Sep. 18, 2009

(87) PCT Pub. No.: WO2008/015258

PCT Pub. Date: Feb. 7, 2008

(65) Prior Publication Data

US 2010/0047108 A1 Feb. 25, 2010

(30) Foreign Application Priority Data

Aug. 3, 2006 (FR) ..... 06 53272

(51) Int. Cl.

| | |
|---|---|
| ***C22B 9/18*** | (2006.01) |
| ***C22C 38/44*** | (2006.01) |
| ***C22C 38/46*** | (2006.01) |
| ***C22C 38/02*** | (2006.01) |

(52) U.S. Cl. ..... 75/10.25; 75/10.48; 148/548

(58) Field of Classification Search ..... 75/10.25, 75/10.48; 148/548

See application file for complete search history.

(56) References Cited

U.S. PATENT DOCUMENTS

| | | | | |
|---|---|---|---|---|
| 3,132,937 | A * | 5/1964 | Sadowski et al. | 420/95 |
| 3,254,991 | A * | 6/1966 | Shimmin, Jr. et al. | 420/108 |
| 4,359,337 | A * | 11/1982 | More | 75/306 |
| 4,993,690 | A * | 2/1991 | Stenzel et al. | 266/158 |
| 5,207,843 | A | 5/1993 | Maloney et al. | |
| 5,252,120 | A | 10/1993 | Finkl et al. | |
| 5,374,322 | A | 12/1994 | Okada et al. | |
| 5,415,834 | A | 5/1995 | Finkl et al. | |
| 6,652,680 | B2 | 11/2003 | Grimm et al. | |
| 2002/0112786 | A1 | 8/2002 | Abe et al. | |
| 2010/0037992 | A1 * | 2/2010 | Gay et al. | 148/593 |

FOREIGN PATENT DOCUMENTS

| | | |
|---|---|---|
| CN | 1676653 | 10/2005 |
| DE | 19531260 A1 | 2/1997 |
| DE | 19531260 C2 | 5/2000 |
| EP | 0577997 | 1/1994 |
| EP | 1087030 | 3/2001 |
| EP | 1239257 | 9/2002 |
| EP | 1445339 | 8/2004 |
| JP | 402050912 | 2/1990 |
| JP | 8120400 | 5/1996 |
| LU | 43979 | 8/1963 |
| SU | 1650715 | 5/1991 |

OTHER PUBLICATIONS

Svajger, Milan et al. "thermodynamic and Kinetic Model for Remelting of EDR Ingots Made of Cr-Ni-Mo-V Steels". 11$^{th}$ International Conference on Vacuum Metallurgy. May 11-14, 1992. pp. 125-127.*

Machine translation of JP 06-128661A by Kihara, S. published May 10, 1994.*

Machine translation of DE 19531260 published Feb. 1997.*

International Search Report for PCT/EP2007/058037 (mailed Oct. 5, 2007).

International Search Report for PCT/EP2007/058035 (mailed Oct. 10, 2007).

Milan et al., "Thermodynamic and kinetic model for remelting of ESR ingots made of chromium-nickel-molybdenum-vanadium steels," Abstract Only, Supplemental 11th International Conference on Vacuum Metallurgy, 1992, Abstract published 1994.

Written Opinion for PCT/EP2007/058037 (mailed Oct. 5, 2007).

Written Opinion for PCT/EP2007/058035 (mailed Oct. 10, 2007).

Brick et al., "Martensite Transformation in Iron-Carbon Alloys," *Structure and Properties of Engineering Materials*, 46th Edition, p. 131 (1997).

Office action from the U.S. Patent and Trademark Office in U.S. Appl. No. 12/376,284, dated Oct. 7, 2011.

* cited by examiner

*Primary Examiner* — George Wyszomierski
*Assistant Examiner* — Tima M McGuthry Banks
(74) *Attorney, Agent, or Firm* — Klarquist Sparkman, LLP

(57) ABSTRACT

The invention relates to a manufacturing process for steel blanks. The invention relates in particular to a manufacturing process of a steel blank comprising electroslag remelting (ESR—ElectroSlag Remelting) or vacuum arc remelting (VAR—Vacuum Arc Remelting) to obtain very good mechanical properties. The blanks obtained can be used especially in the field of the manufacture of pressurised equipment elements and especially cannon tubes.

13 Claims, No Drawings

PROCESS FOR MANUFACTURING STEEL BLANKS

CROSS REFERENCE TO RELATED APPLICATIONS

This is the U.S. National Stage of International Application No. PCT/EP2007/058035, filed Aug. 2, 2007, which was published in English under PCT Article 21(2), which in turn claims the benefit of French Application No. 0653272, filed Aug. 3, 2006. Both applications are incorporated herein in their entirety.

The invention relates to a manufacturing process for steel blanks and in particular blanks of tubes to form at least one pressurised equipment element.

STATE OF THE ART

Very high-performance steels for manufacturing elements of pressurised equipment capable of supporting from 4,000 to 10,000 bars, especially including stoppers or sleeves of cylinder heads or tubes for forming a pressurised equipment element, in particular tubes for cannons have been developed for many years now. These steels must respond to qualities of compositions defined very strictly and must produce very good mechanical properties, and especially of a very high elastic limit, and a good elasticity/tenacity limit ratio, especially at low temperature.

It is especially necessary to get very low silicon and manganese contents, but relatively high chrome, molybdenum and nickel contents.

Different compositions have been proposed in the prior art for producing steels responding to these mechanical properties, however the mechanical characteristics of these steels must be further improved. Such compositions are described especially in the patent DE 195 31 260 C2. The composition must therefore be improved in terms of mechanical properties, and especially in terms of the elastic limit and the elasticity limit/tenacity ratio, in particular at low temperature.

The known processes do not relatively reliably produce steel compositions having the required mechanical properties, especially in terms of elasticity limit and elasticity limit/tenacity ratio at low temperature.

AIMS OF THE INVENTION

The chief aim of the invention is to resolve the technical problems mentioned hereinabove and especially to provide a steel composition allowing elevated mechanical properties, especially in terms of elasticity limit and an optimised elasticity limit/tenacity ratio at low temperature, adapted to form a pressurised equipment element.

The chief aim of the invention is also to resolve the technical problems mentioned hereinabove and especially the technical problem consisting of providing a process for obtaining a composition blank responding to the abovementioned requisites, especially for the manufacture of a steel having very good mechanical properties, especially including a very high elasticity limit, and simultaneously obtaining high values in elasticity limit and in tenacity at low temperature.

The aim of the invention especially is to resolve this technical problem within the scope of manufacturing elements of pressurised equipment.

DESCRIPTION OF THE INVENTION

In particular, a steel blank composition has been discovered, essentially comprising:

Carbon: 0.35-0.43,
Manganese: <0.20,

Silicon: <0.20,
Nickel: 3.00-4.00,
Chrome: 1.30-1.80,
Molybdenum: 0.70-1.00,
Vanadium: 0.20-0.35,
Iron: balance in percentages by weight of the total composition, as well as the inevitable impurities, kept at the lowest level, especially in the form of Copper (preferably <0.100); Aluminium (preferably <0.015); Sulphur (preferably <0.002); Phosphorous (preferably <0.010); Tin (preferably <0.008); Arsenic (preferably <0.010); Antimony (preferably <0.0015); generally introduced essentially by the primary materials; Calcium (preferably <0.004), dioxygen (preferably <0.004); dihydrogen (preferably <0.0002); and dinitrogen (preferably <0.007) generally due essentially to the manufacturing process. This composition responds to the requisites of mechanical properties required to form an element of pressurised equipment supporting from 4000 to 10,000 bars, such as especially stoppers or sleeves of cylinder head or tubes of pressurised equipment.

These steels are not easy to work, especially to the extent where they are out of thermodynamic equilibrium, due to the fact principally of the dinitrogen, dioxygen and dihydrogen contents, associated with the particular carbon, manganese, silicon, nickel and chrome contents.

It was discovered surprisingly that it was possible to resolve the technical problems mentioned hereinabove by using in particular an electroslag remelting process (ESR remelting—<<ElectroSlag Remelting>>) or vacuum (VAR—<<Vacuum Arc Remelting>>) and preferably an electroslag remelting process. An ESR or VAR remelting process should not normally be used for such compositions out of thermodynamic equilibrium, especially not for reducing mechanical properties, and especially the very high elastic limit, required in particular for applications in the field of pressurised equipment and weapons in particular.

Accordingly, the present invention describes a manufacturing process for a steel blank comprising electroslag remelting (ESR—ElectroSlag Remelting) or vacuum arc remelting (VAR—<<Vacuum Arc Remelting>>), said blank having a composition essentially comprising, after ESR or VAR remelting:

Carbon: 0.35-0.43, and preferably 0.37-0.42,
Manganese: <0.20, and preferably <0.15,
Silicon: <0.20, and preferably <0.100,
Nickel: greater than 3.00 and less than or equal to 4.00, and preferably 3.50-3.80,
Chrome: 1.30-1.80, and preferably 1.50-1.70,
Molybdenum preferably 0.70-1.00,
Vanadium preferably 0.20-0.35, and more preferably 0.25-0.30,
Iron: balance in percentages by weight of the total composition, as well as the inevitable impurities especially including dinitrogen (preferably <70 ppm), dioxygen (preferably <30 ppm) and dihydrogen (preferably <2 ppm).

Said process advantageously comprises ESR remelting of an electrode to obtain said blank composition after ESR remelting described hereinabove, the ESR remelting comprising:

a composition of the slag essentially comprising:

$CaF_2$: 60-70;
$Al_2O_3$: 10-20;
CaO: 10-20;
$SiO_2$: 5-10%;

in percentages by weight of the total composition of the slag.

Advantageously, the ESR remelting is carried out in inert atmosphere, and preferably in argon atmosphere.

Advantageously, the process comprises continuous deoxidation of slag by addition of aluminium.

Advantageously, the slag is introduced in liquid or solid form.

Advantageously, the composition of the blank composition after ESR or VAR remelting is essentially:

Carbon: 0.37-0.42,

Manganese: 0.060-0.130,

Silicon: 0.040-0.120,

Nickel: greater than 3.00 and less than or equal to 4.00, and preferably 3.50-3.80, Chrome: 1.30-1.80, and preferably 1.50-1.70, Molybdenum: 0.70-1.00, Vanadium: 0.25-0.30, Aluminium: ≦0.015, and preferably <0.012, in percentages by weight of the total composition, as well as the inevitable impurities.

The blank composition after ESR remelting preferably comprises the inevitable impurities, kept at the lowest level, especially in the form of dioxygen (preferably <30 ppm); dihydrogen (preferably <1.8 ppm); and dinitrogen (preferably <70 ppm).

The other impurities, generally associated with primary materials, are essentially in the form of Copper (preferably <0.100); Aluminium (preferably <0.012); Sulphur (preferably <10 ppm); Phosphorous (preferably <50 ppm); Tin (preferably <0.008); Arsenic (preferably <0.010); Antimony (preferably <0.0015); Calcium (preferably <30 ppm).

According to a particular embodiment, the process comprises prior to the ESR or VAR remelting working of the VAD (Vacuum Arc Degassing) type.

Working the VAD type preferably comprises VCD (Vacuum Carbon Deoxidation) processing comprising measuring oxygen activity, addition of a complement of slag for adjusting the composition of the electrode prior to ESR or VAR remelting to ensure silicon content of less than 0.050%, aluminium of less than 0.012%, at the same time ensuring a dioxygen activity content of less than 10 ppm, final degassing to obtain especially a dihydrogen content<1.2 ppm, and final decantation to ensure elimination of metallic inclusions.

Advantageously, the process comprises prior to working of the VAD type a process for transferring the metal without bringing in slag from the electric oven, preferably a ladle-by-ladle transfer.

The process preferably comprises working on the electric arc oven prior to the ladle-by-ladle transfer.

Advantageously, the process comprises after the slag remelting (ESR) or vacuum remelting (VAR) annealing of the resulting ingot comprising at least constant temperature over an adequate period to ensure essentially complete martensitic transformation of the blank composition obtained after ESR or VAR remelting.

The blank obtained after ESR or VAR remelting especially enables manufacture of all pressurised equipment pieces, especially those such as stoppers or sleeves, especially of cylinder heads, or tubes of pressurised equipment supporting especially from 4000 to 10,000 bars, especially including cannon tubes.

Advantageously, the process comprises transformation by forging after annealing, followed by thermal processing of the blanks to obtain steel essentially having a fully martensitic structure and especially resulting in preferred mechanical properties.

The gas contents of the steel ($O_2$, $N_2$, $H_2$) are dosed advantageously by means of gas analysers.

The invention especially covers steel in any form likely to be obtained at any one of the stages of this process, and especially in the form of a blank, tubes, cylinders, or electrode for ESR or VAR remelting.

Other aims, characteristics and advantages of the invention will appear clearly to the specialist from the following explanatory description which makes reference to examples given solely by way of illustration and which could in no way limit the scope of the invention.

The examples are an integral part of the present invention and any characteristic appearing as novel relative to the prior art from the description taken as a whole, including the examples, is an integral part of the invention in its function and in its generality.

So each example has a general scope.

However, in the examples here all the percentages are given by weight, unless specified otherwise, and the temperature is expressed in Celsius unless specified otherwise, and the pressure is atmospheric pressure, unless specified otherwise.

EXAMPLES

Example 1

ESR Refusion of Electrode Steel

The ESR remelting process is conducted on an electrode having a composition essentially comprising:

Carbon: 0.37-0.42,

Manganese: <0.15,

Silicon: <0.100,

Nickel: 3.50-3.80,

Chrome: 1.50-1.70,

Molybdenum: 0.70-1.00,

Vanadium: 0.25-0.30, in percentages by weight of the total composition, as well as the inevitable impurities, including dinitrogen (preferably <70 ppm), dioxygen (preferably <15 ppm) and dihydrogen (preferably <1.2 ppm).

ESR remelting comprises essentially:

welding of the stub preferably to the foot side of the electrode;

solid slag priming placed between the electrode and the ESR ingot mould or liquid slag added to the base of the ESR ingot mould prior to startup;

the composition of the slag comprises for example: 60-65% CaF2, 10-15% Al2O3, 10-15% CaO, 5 10% SiO2. The slag represents a minimum 2.3% of the weight of the electrode;

the remelting speed is generally of the order of 10 to 20 kg/mn in steady state;

Deoxidation of the slag by addition of Aluminium (<1 kg/tonne electrode);

Remelting in Argon in slight overpressure throughout remelting to avoid taking up in Nitrogen and re-oxidation of the steel.

Advantageously, the process comprises the capping of the part corresponding to the liquid well on completion of remelting. The ingots are then removed from the mould hot as soon as solidification of the head is complete.

Control of the Silica and Alumina contents of the slag especially regulates the homogeneity of the Aluminium and Silicon contents of the remelted ingot. It is preferable to obtain Silicon contents≧0.040% after ESR remelting (typically 0.050/0.100%) to avoid any defect in <<porosities>> type on product.

This blank can then be used for the manufacture of tubes, especially to be used as tubes for the weapons industry, especially including cannon tubes.

Example 2

VAR Refusion of A Steel Electrode

The VAR remelting process is carried out on an electrode having a composition essentially comprising:

Carbon: 0.37-0.42,
Manganese: <0.15,
Silicon: <0.100,
Nickel: 3.50-3.80,
Chrome: 1.50-1.70,
Molybdenum: 0.70-1.00,
Vanadium: 0.25-0.30, in percentages by weight of the total composition, as well as the inevitable impurities including dinitrogen (preferably <70 ppm), dioxygen (preferably <15 ppm) and dihydrogen (preferably <1.2 ppm).

VAR remelting essentially comprises:

welding of the stub preferably to the foot side of the electrode;

low-speed remelting priming the remelting speed is generally of the order of 7 to 16 kg/mn in steady state in vacuum<$10^{-5}$ atmospheres;

Advantageously, the process comprises capping of the part corresponding to the liquid well on completion of remelting. The ingots are then removed from the mould hot as soon as the head solidifies.

This blank can then be used for the manufacture of tubes, especially to be used as tubes for the weapons industry, especially including cannon tubes Example 3

Working the Steel—Obtaining Remelted ESR or VAR Ingots

This example illustrates the preparation of an electrode for ESR or VAR remelting, for example utilisable within the scope of Example 1.

1) Primary Working 1.1 Analysis Aimed for: on Casting and Before ESR or VAR Remelting in %

The general aim is a blank composition prior to ESR or VAR remelting essentially comprising:

C=0.37-0.42
Mn<0.15
If <0.100 at primary working
Ni=3.50/4.00
Cr=1.50-1.70
Mo=0.70-1.00
V=0.25-0.30 in percentages by weight of the total composition, as well as the inevitable impurities, which are generally those indicated hereinbelow whereof the contents are kept as low as possible and preferably according to what is indicated:

S<20 ppm, typical <10 ppm
P<60 ppm—typical <50 ppm
Cu<0.100
Al<0.015, and preferably <0.012
As <0.010
Sn<0.008
Sb<20 ppm
Ca<30 ppm
N2<70 ppm
O2<30 ppm
H2<1.8 ppm in percentages by weight of the total composition.

1.2 Choice of Primary Materials

The choice of primary materials is made to limit the level of impurities, except for aluminium which will act especially as deoxidising of the ensuing slag.

1.3 Electric Arc Oven Processing (EAF)

By way of example, the electric arc oven processing comprises the following stages:

a) Charging the primary materials with the addition of lime and carbon (graphite), and oxidising melting of the metallic elements;
b) Load aim, for example: C between 1.0 and 1.4, If <0.5, Mn<0.4, Cr<0.7, Ni approximately 3.5 and Mo approximately 0.70, P<0.010, S<0.008, V<0.50, in percentages by weight of the total composition;
c) Oxidising melting for example up to approximately 1,500° C.;
d) Dephosphorisation to ensure phosphorous content≦40 ppm;
e) Careful clearing of the slag to approximately 1,580° C.;
f) Addition of lime+CaF2 and heating to reach approximately 1,600° C.;
g) Decarburisation: Blowing oxygen to get for example: 0.150<C<0.200%, Mn<0.08%, If <0.030% P<40 ppm;
h) Heating to approximately 1700° C.
i) Clearing of the slag and measuring O2 activity (<400 ppm).

Measuring O2 activity is done for example by electrochemical column.

1.4 Ladle Casting Transfer:

This stage especially eliminates the oxidised slag from the oven and ensures control of the Manganese, Silicon and Aluminium contents.

This stage comprises no deoxidation of the steel or addition of Carbon (graphite) and the aim is O2 activity of less than 100 ppm.

1.5 Ladle-by-Ladle Transfer in the VAD Processing Ladle, with Initial Addition of Slag to the Base of the VAD Processing Ladle composition of the slag: Lime (for example approximately 50-70%), CaF2 (for example approximately 5 to 10%), and alumina (for example around 10 to 20%) to the base of the VAD ladle;

Ladle-by-ladle transfer: stop before passage of the oven slag.

1.6 VAD Processing: Vacuum Arc Degassing in Vacuum Heating Ladle (APCV)

This stage comprises:

a) VCD PROCESSING: vacuum carbon deoxidation (Vacuum Carbon Deoxidation) to ensure maximal deoxidation of the steel by the reaction: C+O→CO, thus avoiding precipitation of metallic inclusions.

This processing comprises especially measuring O2 activity as well as at least heating to a temperature of over 1,600° C.

b) DEOXIDATION OF SLAG: addition of the complement of slag for adjusting its composition and deoxidation of the latter with Carbon, aluminium and silica-calcium (SiCa) to ensure contents such as for example:

Silicon<0.050% and Aluminium<0.010%, ensuring oxygen content activity<10 ppm.

the composition of the slag can be essentially: Lime (for example approximately 50 to 70%), CaF2 (for example approximately 5 to 10%), and Al2O3 (for example approximately 10 to 20%) which is deoxidised by addition for example of SiCa (for example approximately ⅔), and Al (for example approximately ⅓), and carbon (Graphite) adjusted to attain for example C>0.350%.

heating for example to approximately 1,600° C. and measuring of the oxygen activity (<10 ppm).

c) ANALYTICAL REGULATING: to ensure analytical aims, including Carbon, Manganese and Silicon Heating to for example 1,630/1,650° C.;

Additions of analytical control: Mn, Cr, Ni, Mo, C, V;

heating to for example a temperature above 1,620° C.;

measuring of the O2 activity (<10 ppm).

d) FINAL DEGASSING: lowering the Hydrogen content to a content of less than 1.2 ppm to avoid any later risk of defects of <<hairline cracks>> type or others on product after forging.

These can be employed especially:

degassing for a period greater than approximately 15 mn at a pressure (P) of less than 1.33 mbar (approximately 1 torr;)

heating to approximately 1,600° C.—measuring of the O2 activity (<10 ppm);

control of the dihydrogen content by Hydriss probe.

e) Final Decantation:

Decantation is carried out to ensure elimination of metallic inclusions for a period greater than 15 mn at a pressure of approximately 700 mbar and a temperature of approximately 1,570° C. before casting in ingots.

All the stages of the VAD processing are conducted under partial vacuum (for example approximately 700 mbar) to avoid any re-oxidation of the metal; the process is controlled by measuring the oxygen activity (<10 ppm) throughout the different stages, and initial VCD processing enables control of the state of oxidation of the steel for low Mn contents (<0.050%), If (<0.050%) and Aluminium content of less than 0.012%.

The final degassing processing ensures at the same time a very low Sulphur (<10 ppm) and dioxygen content (<15 ppm) as well as a low dihydrogen (<1.2 ppm) and dinitrogen content<70 ppm).

Final decantation ensures considerable final inclusion cleanliness of the steel.

2) Casting Ingots in Ingot Moulds

The ingots or electrodes for remelting are cast for example en source with Argon protection to avoid any re-oxidation of the metal during casting in ingot moulds.

The electrodes for ESR or VAR remelting are preferably capped to ensure good density before ESR or VAR remelting, as well as good macrographic cleanliness of the ingots.

The casting speed is preferably carefully controlled to avoid any risk of formation of surface cracks on the electrodes.

3) Annealing Electrodes Prior to ESR or VAR Remelting

After complete solidification the ingots or electrodes are removed hot from the mould and cooled slowly in an oven or under heat-insulated caps to a temperature of less than approximately 150-200° C. This temperature is maintained for approximately 6 to 10 hours to ensure complete martensitic transformation of the skin product.

The ingots or electrodes are then brought back up to a temperature of approximately 650° C. in approximately 6 to 8 h in an oven, then kept at this temperature for 24 h minimum for softening. The ingots are then cooled down to approximately 300° C. minimum at slow speed (for example <30° C./h).

4) Preparation of Electrodes

If the ingots have been capped preparation of the electrodes for ESR or VAR remelting is ensured by eliminating the head cap of the ingot (or electrode) obtained earlier.

5) Remelting of Electrodes

Remelting of the electrodes is conducted according to 5.1 or 5.2:

5.1 ESR remelting is carried out according to Example 1, to obtain blanks in the form of ingots (for example of a diameter of 735 mm).

5.2 VAR remelting is carried out according to Example 2, to obtain blanks in the form of ingots (for example of a diameter of 640 or 710 mm).

6) Annealing of ESR or VAR Ingots

Annealing is identical or comparable to that of stage 3. It is however possible to take the ingots back to forging directly after keeping them at 650° C.

7) Transformation: Forging and Thermal Processing

The resulting ingots can be transformed to provide tubes which can be used in pressurised equipment, as a weapons element, such as cannon tubes, cylinder head elements, taking into consideration the mechanical properties due to the composition of the steel and the manufacturing process.

These ingots can especially undergo the following transformational stages:

7.1 Heating of ingots before forging:

The ingots are heated in several stages to decrease segregations on product (for example at least 15 h);

7.2 Forging of tubes (for example of an internal diameter 120 mm) comprising at least one hot;

7.3 Annealing after forging to improve the microstructure of the steel (Normalisation stage) and to avoid any risk of cracking during cooling (oven cooling stage) and to avoid the appearance of <<hairline cracks>> or <<DDH>> on the products after cooling (DDH=Defects Due to Hydrogen) with anti-hairline crack annealing when the ESR ingots have been remelted in solid slag.

7.4 Pre-forging can then be carried out on the thermal processing profile comprising quality thermal processing.

7.5 The object quality processing is to confer on the tubes all required mechanical properties by optimising the elastic limit/resilience compromise at −40° C. and K1c (or KQ) or J1c at −40° C.

Quenching in a liquid of adapted severity leads to a totally martensitic structure by avoiding the risk of cracking. This thermal quality processing advantageously comprises a first tempering above 500° C. at maximum hardness; performing two temperings at very close temperatures ensures considerable homogeneity of the mechanical characteristics along the tube by improving the level of resilience; performing two temperings and slow oven cooling oven after the final tempering guarantees the final straightness of the tube, and the absence of deformations during final machining.

The invention claimed is:

1. A manufacturing process for a steel blank comprising electroslag remelting (ESR—ElectroSlag Remelting) of an electrode, said blank having a composition comprising, after ESR:

Carbon: 0.35-0.43,

Manganese: <0.20,

Silicon: <0.20,

Nickel: greater than 3.00 and less than or equal to 4.00,

Chrome: 1.30-1.80,

Molybdenum: 0.70-1.00,

Vanadium: 0.20-0.35,

Iron: balance in percentages by weight of the total composition, and including dinitrogen, dioxygen and dihydrogen, wherein the composition of the slag for ESR comprises:

$CaF_2$: 60-70;

$Al_2O_3$: 10-20;

CaO: 10-20;

$SiO_2$: 5-10;

in percentages by weight of the total composition of the slag.

2. The process as claimed in claim 1, wherein said blank composition comprises, after ESR:

Carbon: 0.37-0.42,

Manganese: <0.15,

Silicon: <0.100,

Nickel: 3.50-3.80,

Chrome: 1.50-1.70,

Molybdenum: 0.70-1.00,

Vanadium: 0.25-0.30,

Iron: balance in percentages by weight of the total composition, and includes dinitrogen at <70 ppm, dioxygen at <30 ppm and dihydrogen at <1.8 ppm.

3. The process as claimed in claim 2, further comprising continuous deoxidation of the slag by addition of aluminium.

4. The process as claimed in claim 2, further comprising performing the ESR remelting in an inert atmosphere.

5. The process as claimed in claim 1, further comprising performing VAD type (Vacuum Arc Degassing) prior to the ESR.

6. The process as claimed in claim 5, further comprising transferring of metal without bringing in slag from an electric oven, prior to the working of the VAD type.

7. The process as claimed in claim 6, further comprising an electric arc oven processing prior to transferring of metal without bringing in slag from the electric oven.

8. The process as claimed claim 5, wherein said VAD step comprises VCD processing (Vacuum Carbon Deoxidation) comprising measuring oxygen activity, addition of a complement of slag for adjusting the composition of the electrode before ESR to ensure silicon contents of less than 0.050%, aluminium of less than 0.012%, at the same time ensuring dioxygen activity content of less than 10 ppm, the final degassing to obtain dihydrogen content<1.2 ppm, and final decantation to ensure elimination of metallic inclusions.

9. The process as claimed in claim 1, further comprising annealing comprising at least maintaining temperature for an adequate period to ensure essentially completely martensitic transformation of the blank composition obtained after ESR.

10. The process as claimed in claim 9, further comprising transformation of the blanks by forging, followed by thermal processing to obtain steel having essentially a fully martensitic structure after annealing.

11. The process of claim 1, wherein said blank is further processed to prepare a pressurized equipment element.

12. A manufacturing process for a steel blank comprising electroslag remelting (ESR—ElectroSlag Remelting) of an electrode, said blank having a composition comprising, after ESR:

Carbon: 0.37-0.42,

Manganese: 0.060-0.130,

Silicon: 0.040-0.120,

Nickel: greater than 3.00 and less than or equal to 4.00,

Chrome: 1.30-1.80,

Molybdenum: 0.70-1.00

Vanadium: 0.25-0.30,

Aluminium: ≦0.015, in percentages by weight of the total composition, and includes dinitrogen at <70 ppm, dioxygen at <30 ppm and dihydrogen at <1.8 ppm, wherein the composition of the slag for ESR comprises:

$CaF_2$: 60-70;

$Al2O_3$: 10-20;

CaO: 10-20

$SiO_2$: 5-10;

in percentages by weight of the total composition of the slag.

13. The process of claim 12, wherein said blank is further processed to prepare a pressurized equipment element.

* * * * *